US005404786A

United States Patent [19]

Gatzen

[11] Patent Number: 5,404,786

[45] Date of Patent: Apr. 11, 1995

[54] DRUM MOUNTING ARRANGEMENT

[75] Inventor: Robert A. Gatzen, Newington, Conn.

[73] Assignee: Noble and Cooley Company, Inc., Granville, Mass.

[21] Appl. No.: 194,510

[22] Filed: Feb. 10, 1994

[51] Int. Cl.[6] ..... G10D 13/02

[52] U.S. Cl. ..... 84/421

[58] Field of Search ..... 84/421, 411 R, 453; 224/910

[56] References Cited

U.S. PATENT DOCUMENTS 4,158,980 6/1979 Gauger ..... 84/421

4,252,047 2/1981 Gauger ..... 84/421

*Primary Examiner*—Michael L. Gellner

*Assistant Examiner*—Cassandra Spyrou

*Attorney, Agent, or Firm*—Kokjer, Kircher, Bowman & Johnson

[57] ABSTRACT

A system for mounting a musical drum on a stand. A semicircular mounting band has projecting tabs which are mounted to the lower ends of a pair of drum tension lugs located 180° apart on the drum body. The mounting band has a bracket at its center which clamps onto the stand. The mounting system avoids unduly detracting from the drum sound or servicing of the drum.

8 Claims, 2 Drawing Sheets

DRUM MOUNTING ARRANGEMENT

FIELD OF THE INVENTION

This invention relates generally to musical drums and more particularly to an improved mounting system for mounting a drum on a support stand.

BACKGROUND OF THE INVENTION

A considerable amount of effort has been devoted to the improvement of the sound quality of drums. Most of the effort has been directed to the design of the shell and head of the drum and to systems for controlling the tension of the drumhead. Despite the considerable improvements that have been made in these areas, little has been done to improve the manner in which a drum is mounted on a stand. The acoustical properties of a drum suffer significant adverse effects because of the way in which the drum is mounted.

Currently, two predominant techniques are used for the mounting of drums. One technique involves drilling holes in the shell and using screws or other fasteners to connect a mounting bracket directly to the shell. The bracket can be fastened to the stand in order to mount the drum at the desired location. Although this method is commonly used, the need to drill holes in the shell detracts significantly from the tone and quality of the sound.

The other commonly used mounting technique employs a suspension system which allows the drum to vibrate in a relatively free manner, thus enhancing the tone and "feel" of the drum. However, suspension systems of this type become decreasingly effective as the drum size increases because of the increased stress on the shell and head and on the suspension components as the drum becomes larger and heavier. The tone degradation is considerable in many cases. Also, the suspension system typically suspends the drum by its rim or requires a separate mounting bracket which is attached to the shell. Neither technique is wholly successful in eliminating acoustical distortions caused by the mounting system. Rim mounted systems are located adjacent to the top or batter head of the drum, and this creates an asymmetrical condition between the batter head and the resonant or lower drumhead. The asymmetry prevents the two heads from sustaining in phase vibration which creates the predominant drum sound.

SUMMARY OF THE INVENTION

The present invention is directed to an improved drum mounting system which allows the drum to exhibit more favorable acoustical properties than drums mounted by means of other mounting systems.

In accordance with the invention, a mounting band extends approximately half way around the drum shell and is connected to the bottom ends of two diametrically opposed tension lugs on the drum shell. The band is equipped with a mounting bracket located midway between the two tension lugs, and the bracket can be applied to and tightened on a stand to which the drum is mounted.

It is noteworthy that the components of the mounting system are attached to tension lugs that are already present on the shell. Consequently, there are no additional holes required in the shell, and the undesirable acoustical effects of added holes are avoided. It is also noteworthy that the band is attached to tension lugs which are approximately 180° apart on the drum body.

These lugs are arranged symmetrically on the circumference of the drum and are located at stress areas where the damping effect of the hardware is concentrated. By taking advantage of this damping effect, selected vibrational frequencies are controlled in a manner permitting the two heads to sympathize with the shell vibration such that the sustain period of the drum is prolonged.

Another important feature of the invention is the attachment of the mounting band to the lower ends of the tension lugs rather than to the top ends which are closer to the batter head. This mounting location avoids interference with the rim of the batter head and allows the vibration of the two heads to remain in phase longer than occurs with systems having components closer to the batter head. Also, the drum can be serviced easily because the drumhead can be replaced without disturbing the mounting band or other components of the mounting system.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 3:
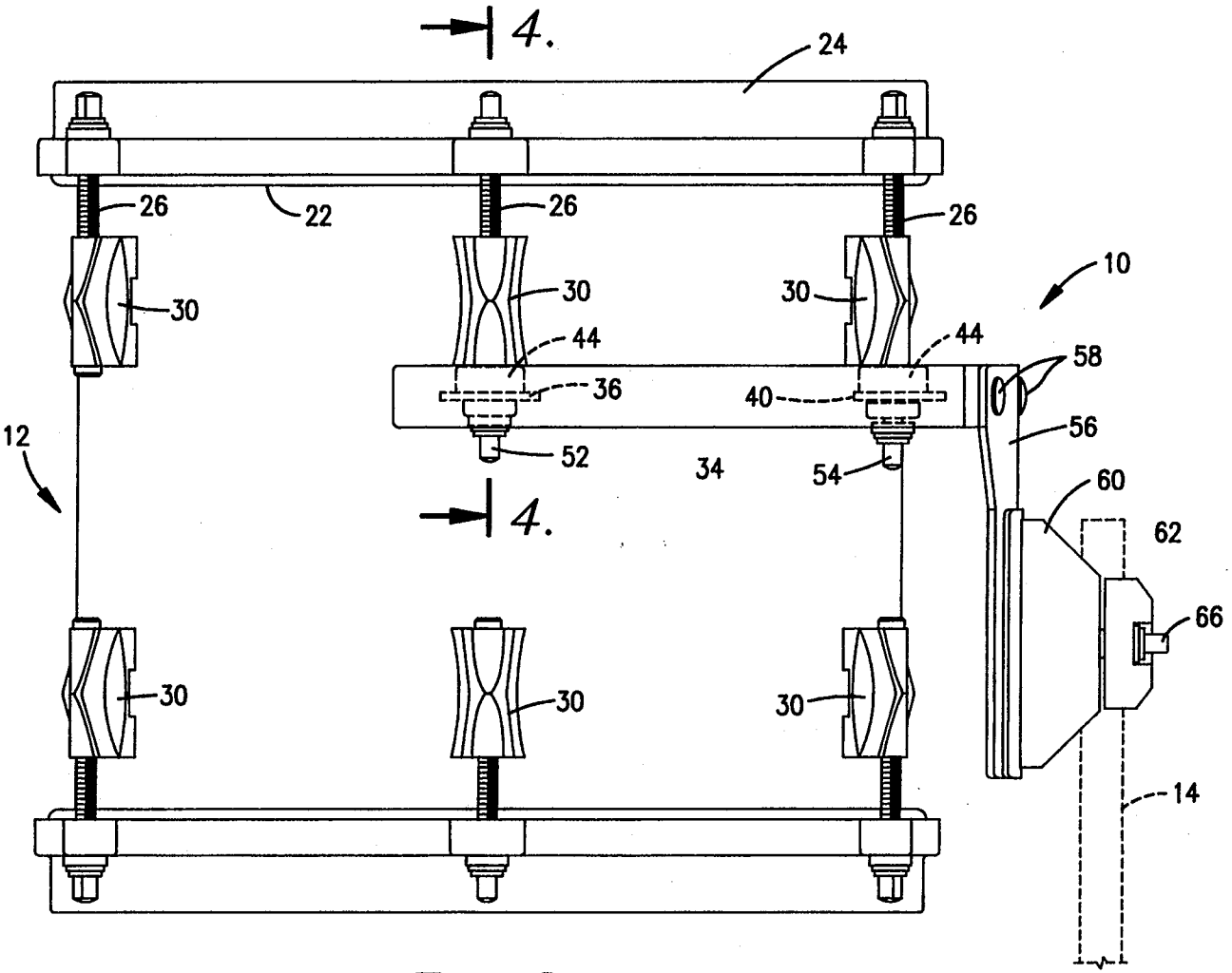
FIG. 3 is a side elevational view showing the mounting band and related components applied to a drum and used to mount the drum on a stand.

Referring now to the drawings in more detail, numeral 10 generally designates a mounting device constructed according to a preferred embodiment of the present invention. As shown in FIG. 3, the device 10 is used to mount a drum 12 on a suitable stand which includes a generally upright rod or post 14.

The drum 12 has a conventional construction. A cylindrical shell 16 forms the body of the drum. A batter head 18 is applied to the top end of the shell 16 in a manner best shown in FIG. 4. The edge of the head 18 is embedded in a body of resin 20 which is contained in a hoop 22. A counter hoop or rim 24 acts against the top of the hoop 22. A plurality of tension screws 26 extend through the hoop 24 at equally spaced increments around its circumference. The screws 26 are threaded into threaded passages 28 which are formed through tension lugs that are equally spaced around the circumference of the shell 16. Each lug 30 is secured in place by a pair of screws 32 which extend through holes drilled in the shell 16 and are threaded into the lugs 30.

The tension of the batter head 18 is controlled by tightening or loosening screws 26 in a conventional and well known manner. The bottom end of the shell 16 is similarly equipped with a resonant head (not shown). The resonant head is secured on the shell and adjusted as to its tension in a manner similar to the batter head 18. In use of the drum, only the batter head 18 is struck, and the resonant head vibrates only as a result of the forces caused by striking of the batter head.

Figure 1:
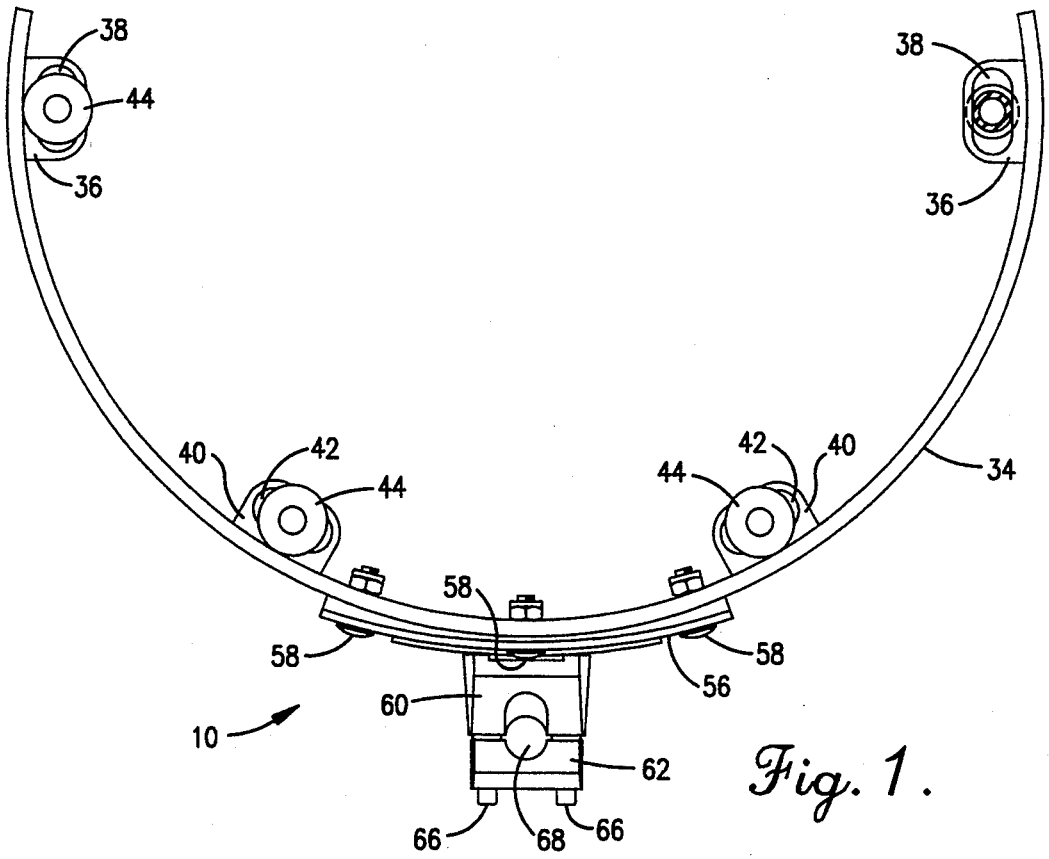
FIG. 1 is a plan view of a mounting band and accompanying components which are used to mount a drum on a stand in accordance with a preferred embodiment of the present invention.
Figure 2:
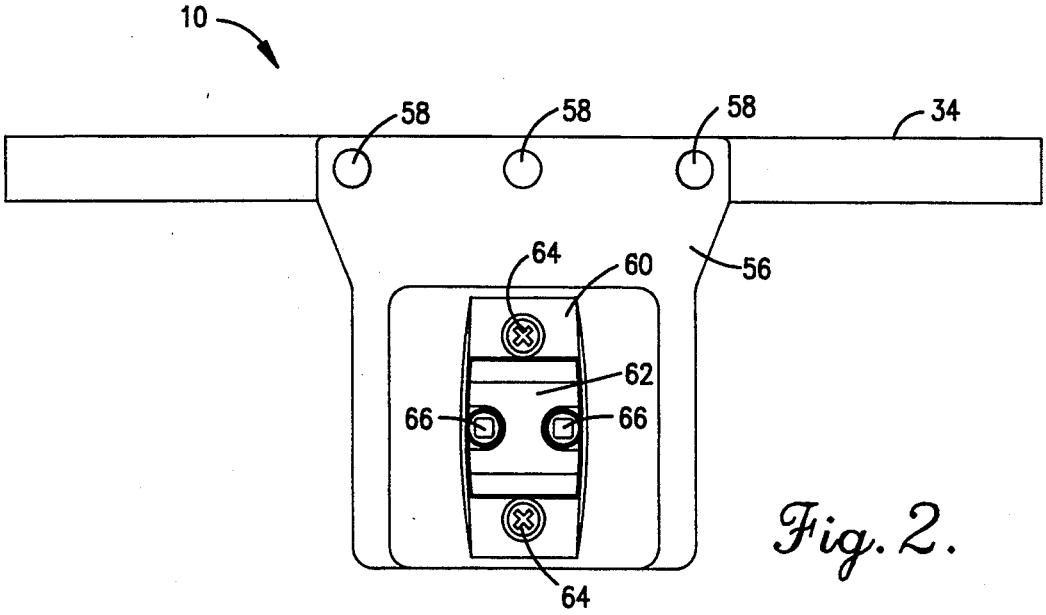
FIG. 2 is a front elevational view of the mounting band and related components.

With particular reference to FIGS. 1 and 2, the mounting device 10 includes a generally semi-circular band 34 which has a strap-like construction and includes free ends 34*a* which are approximately diametrically opposite to one another. The band 34 has a slightly larger diameter than the shell 16 and a length to extend slightly more than half way around the circumference of the shell.

Near its free ends 34*a*, the strap 34 is provided with a pair of inwardly projecting mounting tabs 36. Each of the tabs 36 is a flat element which projects from the strap at a location approximately midway along its width. The tabs 36 are located 180° apart from one another on the band 34 and are situated to correspond with the locations of two of the mounting lugs 30 which are located 180° apart on the drum shell 16. Each tab 36 is provided with a slot 38 which is elongated in a direction parallel to an adjacent tangent to the band 34.

The band 34 has another pair of inwardly projecting tabs 40 which are located between the two end tabs 36 and are spaced apart from one another to correspond with the locations of additional tension lugs 30. Each of the tabs 40 is provided with a slot 42 which is elongated in a direction parallel to an adjacent tangent to the band 34.

Figure 4:
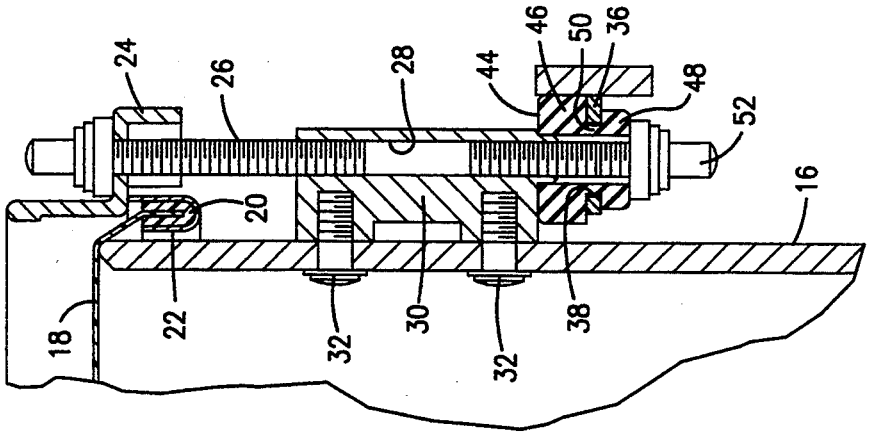
FIG. 4 is a fragmentary sectional view on an enlarged scale taken generally along line 4—4 of FIG. 3 in the direction of the arrows.

Each of the slots 38 and 42 is provided with a rubber grommet 44 which is best illustrated in FIG. 4. The upper portion of each grommet 44 is in the form of an enlarged head 46 having a diameter greater than the width of slot 38 or 42. The bottom portion of each grommet presents a somewhat smaller base 48 which is smaller in diameter than the head 46 but greater in diameter than the width of slot 38 or 42. Between the head 46 and base 48 of each grommet, a reduced diameter neck 50 is formed, and its diameter is slightly less than the width of slot 38 or 42. The neck 50 fits in the slot, and the grommet 44 is held by the fit of tab 36 or 40 in the grove formed adjacent to the neck 50 between the head 46 and base 48 of each grommet.

The band 34 is attached to the drum 10 by a pair of screws 52. The screws 52 are extended through central passages formed in the grommets 44 which are carried on the end tabs 36. In accordance with the invention, the passages 28 extend completely through the lugs 30, and the screws 52 are threaded into the lower ends of the passages 28 in the corresponding tension lugs 30. When each of these screws 52 is tightened, the grommets 44 are compressed against the bottom ends of the corresponding lugs 30, and the tabs 36 are tightly gripped between the head 46 and base 48 of the grommet, as best shown in FIG. 4. The slots 38 allow side to side adjustment of the hand 34 when the screws 52 are loose, and this limited adjustment is often helpful in achieving desirable positioning of the band on the drum.

The intermediate grommets 44 and tabs 40 similarly fit against the undersides of the tension lugs 30 which correspond to their locations. Screws 54 (one of which is shown in FIG. 3) are extended loosely through these grommets and are preferably threaded only partially into the passages 28 of the lugs such that the screws 24 are not fully tightened. This arrangement provides stability for the mounting band 34 in the locations of the tabs 40 while at the same time maintaining the mounting band securely fixed to the lugs at only two locations which are spaced approximately 180° apart on the shell of the drum.

At a location midway along the length of the band 34 and midway between the tabs 36, a generally flat panel 56 is secured to the outer face of the band by three fasteners 58 which may take the form of nut and bolt assemblies. A mounting bracket which is secured to panel 56 takes the form of a pair of clamp elements 60 and 62. Clamp element 60 is secured to the face of the panel 56 by a pair of screws 64 (see FIG. 2). The other clamp element 62 is in turn connected with clamp element 60 by a pair of screws 66. As best shown in FIG. 1, the two clamp elements 60 and 62 cooperate to present a cylindrical opening 68. The opening 68 can be applied to the post 14 in the manner shown in FIG. 3, and the screws 66 can then be tightened in order to clamp the mounting bracket onto the post 14. This in turn mounts the drum 10 on the stand which includes the post 14.

It is again pointed out that the locations of the tension lugs 30 to which the mounting band 24 is fixed are located approximately 180° apart on the drum body. The present invention contemplates that these locations can each vary from a 180° position by plus or minus about 12.5° without detracting significantly from the improved results obtained by the invention.

It is noted that the top end of each tension lug 30 is a proximal end of the lug which is located closer to the batter head 18 than the lower or distal end of the lug. The tension screws 26 are each threaded into the top or proximal end of each lug 30, while the mounting band is attached by screws 52 to the bottom or distal end of two diametrically opposed lugs 30. By virtue of this manner of mounting the band 34, the mounting system for the drum is located well away from the top rim 24 and does not interfere with the rim 24 or batter head 18. Also, the mounting system is located more closely to the vertical center of the drum and thus minimizes any asymmetry as to the upper and lower heads.

By affixing the mounting band 34 to a pair of diametrically opposed lugs 30, the band is connected symmetrically and at locations corresponding to stress areas where damping occurs as a result of the hardware attachment. By mounting the band to the existing lugs, advantage of this damping is taken, and there is no need to provide additional holes or other modifications of the shell in order to accommodate the mounting system. By attaching the mounting system at locations of existing stress areas, the vibrational frequencies are damped in a controlled manner that allows the batter head 18 and the resonant head to sympathize with the shell vibration and thus increase the sustain period of the predominant drum sound. The overall result is that the mounting system has no noticeable adverse effects on the sound tone or quality.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. Apparatus for mounting a drum having a shell presenting a top end and a bottom end, a batter head on the top end of the shell, a resonant head on the bottom end of the shell, tension adjustment means for the batter head including a plurality of tension elements on the shell each having a proximal end relatively close to the batter head, and a distal end relatively distant from the batter head, a plurality of tension fasteners each threaded into the proximal end of a respective one of the tension elements for adjusting the batter head tension, said apparatus comprising:

a curved band having a plurality of connection elements;

a plurality of fastening elements for fastening said connection elements to the distal end of selected ones of said tension elements to connect said band with the shell of the drum, said fastening elements being separate from said tension fasteners and each being threaded into said distal end of one of the selected ones of said tension elements; and a mounting bracket on said band having means for attachment to a stand, thereby mounting the drum on the stand.

2. Apparatus as set forth in claim 1, wherein said selected ones of said tension elements include a pair of tension elements spaced apart approximately 180° on the shell.

3. Apparatus as set forth in claim 2, wherein said mounting bracket is located approximately midway between said pair of tension elements.

4. Apparatus as set forth in claim 3, wherein:

said connection elements comprise projections extending from the band, each of said projections having a slot through which a corresponding one of said fastening elements is extended with said slots being elongated in a direction generally parallel to an adjacent tangent to said band to accommodate side to side adjustment of the band.

5. Apparatus as set forth in claim 4, including a grommet extending through each of said slots and fastened to said corresponding one of said tension elements by a corresponding one of said fastening elements.

6. In combination with a drum stand and a drum having a shell, a batter head on the shell which is struck when the drum is played, and a plurality of tension elements on the shell including a pair of tension elements located approximately 180° apart and each having a lower end and an upper end located closer to the batter head than said lower end, and a plurality of tension fasteners threaded into said upper ends of a respective one of the tension elements for adjusting the batter head tension, a mounting arrangement comprising:

a curved band having a length and a curvature to extend generally along the shell between said pair of tension elements;

a pair of connection elements on said band;

a pair of fastening elements each extending through a respective one of said connection elements and threaded into the lower end of one of the tension elements to secure said band to the lower end of said one of said pair of tension elements; and a mounting bracket on said band at a location generally midway between the tension elements, said bracket having means or attachment to said drum stand to mount the drum thereon.

7. The mounting arrangement of claim 6, including a slot in each of said connection elements for receiving a corresponding one of the fastening elements, each of said slots being elongated in a direction generally parallel to an adjacent tangent to the band to accommodate side to side adjustment of the band when the fastening elements are loose.

8. The mounting arrangement of claim 7, including a grommet in each of said slots, said fastening elements being effective to secure the grommets to the lower end of each of said tension elements.

* * * * *